US011614088B2

(12) United States Patent
Dom et al.

(10) Patent No.: US 11,614,088 B2
(45) Date of Patent: Mar. 28, 2023

(54) METHOD OF CONTROLLING THE TEMPERATURE AND MASS FLOW OF A LIQUID INJECTED INTO THE BEARINGS AND COMPRESSOR SPACE OF A COMPRESSOR USING TWO SEPARATED LIQUID SUPPLIES

(71) Applicant: ATLAS COPCO AIRPOWER, NAAMLOZE VENNOOTSCHAP, Wilrijk (BE)

(72) Inventors: Johan Julia J. Dom, Wilrijk (BE); Jochen Emiel Corneel Theelen, Wilrijk (BE); Shramik Kantilal Dahale, Wilrijk (BE); Luc Henri Arthur Albert Van Hoey, Wilrijk (BE); Diego Truyen, Wilrijk (BE); Kristof Pieter Frans Marcelis, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 344 days.

(21) Appl. No.: 16/060,560

(22) PCT Filed: Aug. 23, 2016

(86) PCT No.: PCT/BE2016/000044
§ 371 (c)(1),
(2) Date: Jun. 8, 2018

(87) PCT Pub. No.: WO2017/096438
PCT Pub. Date: Jun. 15, 2017

(65) Prior Publication Data

US 2018/0363652 A1 Dec. 20, 2018

Related U.S. Application Data

(60) Provisional application No. 62/266,092, filed on Dec. 11, 2015.

(30) Foreign Application Priority Data

Mar. 1, 2016 (BE) ..... 2016/5147

(51) Int. Cl.
*F04C 29/00* (2006.01)
*F04C 29/02* (2006.01)
(Continued)

(52) U.S. Cl.
CPC ..... *F04C 29/0014* (2013.01); *F04C 29/021* (2013.01); *F04C 29/026* (2013.01);
(Continued)

(58) Field of Classification Search
CPC ..... F04C 29/0014; F04C 29/021; F04C 18/08
See application file for complete search history.

(56) References Cited

U.S. PATENT DOCUMENTS 3,073,514 A * 1/1963 Bailey ..... F04C 29/0007 418/87
3,129,877 A * 4/1964 Nilsson ..... F04C 18/16 418/83
(Continued)

FOREIGN PATENT DOCUMENTS

BE 1017320 * 6/2008 ..... F04C 29/02
DE 102012102346 A1 9/2013
(Continued)

OTHER PUBLICATIONS

International Search Report in PCT/BE2016/000044, dated Feb. 24, 2017.
Written Opinion in PCT/BE2016/000044, dated Feb. 24, 2017.

*Primary Examiner* — Nathan C Zollinger
*Assistant Examiner* — Timothy P Solak
(74) *Attorney, Agent, or Firm* — Bacon & Thomas, PLLC

(57) ABSTRACT

A method for controlling the liquid injection of a compressor device, where the compressor device includes at least one
(Continued)

compressor element, the compressor element includes a housing that includes a compression space in which at least one rotor is rotatably affixed by bearings, and liquid is injected into the compressor element. The method includes providing two independent separated liquid supplies to the compressor element, where one liquid supply is injected into the compression space and the other liquid supply is injected at the location of the bearings.

3 Claims, 5 Drawing Sheets

(51) Int. Cl.

| | |
|---|---|
| ***F04C 29/04*** | (2006.01) |
| *F04C 18/16* | (2006.01) |
| *F04C 27/00* | (2006.01) |
| *F04C 28/28* | (2006.01) |

(52) U.S. Cl.
CPC ..... *F04C 29/028* (2013.01); *F04C 29/042* (2013.01); *F04C 18/16* (2013.01); *F04C 27/00* (2013.01); *F04C 28/28* (2013.01); *F04C 2240/20* (2013.01); *F04C 2240/30* (2013.01); *F04C 2240/52* (2013.01)

(56) References Cited

U.S. PATENT DOCUMENTS 4,173,440 A * 11/1979 Libis ..... F04C 29/02 418/84
4,526,523 A * 7/1985 Parker ..... F04C 29/0014 184/6.11
4,780,061 A * 10/1988 Butterworth ..... F04C 29/026 417/372
5,028,220 A 7/1991 Holdsworth
5,653,585 A * 8/1997 Fresco ..... F25B 1/047 418/94
5,765,392 A * 6/1998 Baur ..... F04C 29/02 62/84
5,957,676 A * 9/1999 Peeters ..... F04C 29/02 418/1
6,612,820 B1 * 9/2003 Staat et al. ..... F04C 18/16 418/1
8,454,334 B2 * 6/2013 Heger ..... F04C 18/16 418/83
2007/0163840 A1 * 7/2007 Sekiya ..... F04C 29/021 184/6.16
2007/0253854 A1 * 11/2007 Dunn ..... F04C 23/008 418/55.6
2011/0076174 A1 * 3/2011 Kakiuchi ..... F04C 18/16 418/99
2012/0237382 A1 * 9/2012 Yoshimura ..... F04C 29/028 418/85
2015/0030491 A1 * 1/2015 Desiron ..... F04C 18/16 418/205

FOREIGN PATENT DOCUMENTS

| | | | |
|---|---|---|---|
| EP | 0000131 | A1 | 1/1979 |
| EP | 0030275 | A1 | 6/1981 |
| EP | 0600313 | A1 | 6/1994 |
| EP | 2896834 | A1 | 7/2015 |
| GB | 2115876 | A | 9/1983 |
| JP | 2001323887 | A | 11/2001 |
| JP | 2002039069 | A | 2/2002 |
| WO | 0151813 | A1 | 7/2001 |

* cited by examiner

METHOD OF CONTROLLING THE TEMPERATURE AND MASS FLOW OF A LIQUID INJECTED INTO THE BEARINGS AND COMPRESSOR SPACE OF A COMPRESSOR USING TWO SEPARATED LIQUID SUPPLIES

BACKGROUND OF THE INVENTION

The present invention relates to a method for controlling the liquid injection of a compressor device.

It is known for example that for the cooling of a compressor device, a liquid, such as oil or water for example, is injected into the compression space of the compressor element.

In this way the temperature at the outlet of the compressor element for example can be kept within certain limits, so that the temperature does not become too low so that the formation of condensate in the compressed air is prevented, and whereby the liquid temperature does not become too high so that the quality of the liquid remains optimum.

The injected liquid can also be used for the sealing and lubrication of the compressor element so that a good operation can be obtained.

It is known that the quantity and temperature of the injected liquid will affect the efficiency of the cooling, the sealing and the lubrication.

Methods are already known for controlling the liquid injection in a compressor device, whereby use is made of a control based on the temperature of the injected liquid, whereby the control consists of getting the temperature of the injected liquid to fall if more cooling is desired, by having the liquid pass through a cooler.

By controlling the temperature, the viscosity of the liquid, and thus the lubricating and sealing properties thereof, can also be adjusted.

A disadvantage of such a method is that the minimum attainable temperature of the injected liquid is limited by the temperature of the coolant that is used in the cooler.

Methods are also known for controlling the liquid injection in a compressor device, whereby use is made of a control based on the mass flow of the injected liquid, whereby the control consists of injecting more liquid if more cooling is desired for example.

By injecting more liquid the temperature will rise less. This enables a higher injection temperature without exceeding the maximum outlet temperature, so that overdimensioning of the cooler is not required in the event of a low coolant temperature.

A disadvantage of such a method is that it will only enable the temperature of the injection liquid to be controlled indirectly.

An additional disadvantage of the known methods is that when a proportion of the injected liquid is used to lubricate the bearings, this liquid will have the same temperature as the liquid that is injected into the compression space for the cooling thereof.

It has turned out in practice that in such compressor devices the lifetime of the bearings is detrimentally affected by the liquid temperature.

An example of such devices can be found in US 2012/237,382 and U.S. Pat. No. 4,780,061 where oil is reaching the compression space or the bearings through a configuration of channels.

SUMMARY OF THE INVENTION

The purpose of the present invention is to provide a solution to a least one of the aforementioned and other disadvantages and/or to optimise the efficiency of the compressor device.

The object of the present invention is a method for controlling the liquid injection of a compressor element, whereby the compressor element comprises a housing that comprises a compression space in which at least one rotor is rotatably affixed by means of bearings, whereby liquid is injected into the compressor element, whereby the method comprises the step of providing two independent separated liquid supplies to the compressor element, whereby one liquid supply is injected into the compression space and the other liquid supply is injected at the location of the bearings.

'Independent separated liquid supplies' means that the liquid supplies follow a separate path or route, that starts for example from a liquid reservoir and ends in the compression space or at the location of the bearings respectively.

An advantage is that for each liquid supply, the properties of the injected liquid, such as the temperature and/or mass flow for example, can be controlled separately.

In this way an optimum liquid supply can be provided both for the bearings and for the compression space with the rotors.

In this way the compressor element can operate more optimally and more efficiently than the already known compressor elements.

In the most preferred embodiment the method comprises the step of controlling both the temperature of the liquid and the mass flow of the liquid, for both liquid supplies separately.

This means: the temperature and the mass flow are controlled for each liquid supply, whereby the control for the one liquid supply is done independently of the other liquid supply.

This has the advantage that both the temperature and the quantity of liquid are specifically attuned to the needs of the bearings or the compression space, as the control of the one liquid supply is completely independent of the other liquid supply.

Also it is no longer necessary to provide an overdimensioned cooler.

Moreover, the control of both the temperature and the quantity of liquid has the additional advantage that a synergistic effect will occur.

Both the separate optimisation of the temperature and the quantity of injected liquid will have a positive effect on the efficiency of the compressor element.

But when both are optimised, there will be a functional interaction between the two controls that yields an improvement in the efficiency of the compressor element that is greater than the sum of the efficiency improvements of both individual controls, so that the controls concern a combination and not merely an aggregation or juxtaposition.

This functional interaction is partly attributable to deaeration phenomena that relate to the quantity of air dissolved in the liquid.

By controlling both the temperature and the mass flow, the quantity of air dissolved in the liquid is at least partially eliminated, which will increase the efficiency.

On the other hand, account has to be taken of the sealing capacity, partly attributable to the viscosity of the injected liquid and partly to the available mass flow of the liquid. For each operating point there is an ideal combination of liquid flow and viscosity, which is a function of the temperature, whereby both parameters strengthen one another.

The invention also concerns a liquid-injected compressor device, whereby this compressor device comprises at least one compressor element, whereby the compressor element comprises a housing that comprises a compression space in which at least one rotor is rotatably affixed by means of bearings, whereby the compressor device is further provided with a gas inlet and an outlet for compressed gas that is connected to a liquid separator, which is connected to the compressor element by means of an injection circuit, whereby the aforementioned injection circuit comprises two separate injection pipes that start from the liquid separator and which open into the compression space and into the housing at the location of the aforementioned bearings respectively.

Such a compressor installation has the advantage that the liquid supplies for the lubrication of the bearings and for the cooling of the compression space can be controlled independently of one another, so that both liquid supplies can be controlled according to the optimum properties that are needed for the bearings and for the compression space respectively at that specific operating point.

The invention also concerns a liquid-injected compressor element with a housing that comprises a compression space in which at least one rotor is rotatably affixed by means of bearings, whereby the compressor element is further provided with a connection for an injection circuit for the injection of liquid into the compressor element, whereby the connection to the injection circuit is realised by means of a number of injection points in the housing, whereby the housing is further provided with separated integrated channels that start from the aforementioned injection points in the housing and open into the compression space and at the aforementioned bearings respectively.

Such a liquid-injected compressor element can be used in a compressor device according to the invention. In this way at least a proportion of the injection pipes of the injection circuit of the compressor device will as it were extend partially separately in the housing of the compressor element in the form of the aforementioned integrated channels.

Such an approach will ensure that the number of injection points that provide the connection of the injection pipes can be kept limited and that for example the division of the liquid supply to the different bearings can be realised by a suitable division of the channels in the housing.

The location of the injection points can also be freely chosen, whereby the channels in the housing will ensure that the oil supply is guided to the appropriate location.

BRIEF DESCRIPTION OF THE DRAWINGS

With the intention of better showing the characteristics of the invention, a few preferred variants of a method for controlling the liquid injection of a compressor device and a liquid-injected compressor device thereby applied, are described hereinafter by way of an example, without any limiting nature, with reference to the accompanying drawings, wherein.

DETAILED DESCRIPTION OF THE INVENTION

Figure 1:
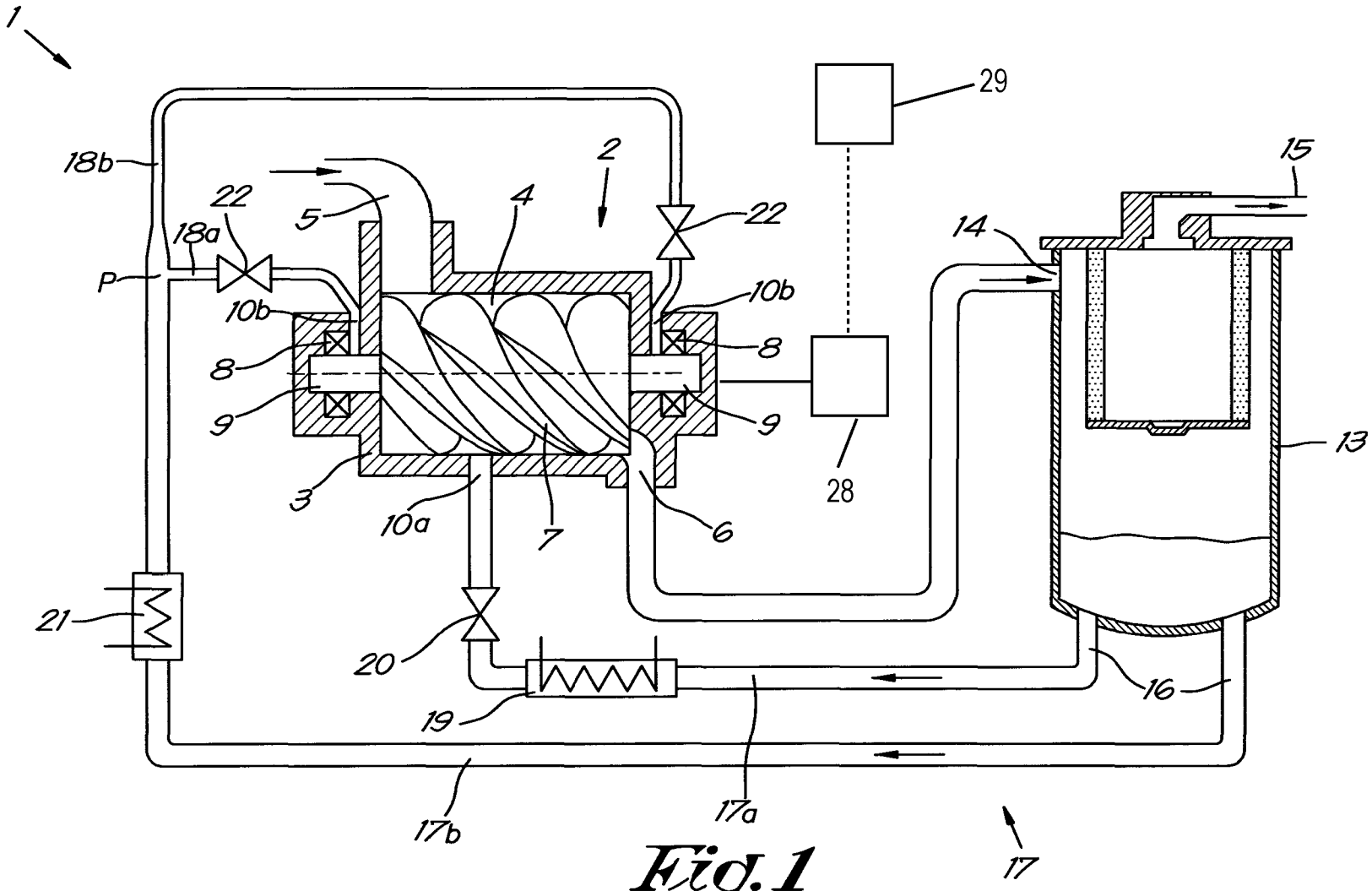
FIG. 1 schematically shows a liquid-injected compressor device according to the invention.

The liquid-injected compressor device 1 shown in FIG. 1 comprises a liquid-injected compressor element 2.

The compressor element 2 comprises a housing 3 that defines a compression space 4 with a gas inlet 5 and an outlet 6 for compressed gas.

One or more rotors 7 are rotatably affixed in the housing 3 by means of bearings 8 that are affixed on the shafts 9 of the rotors 7. The rotors 7 are driven, for example, by engine/motor/gearbox 28, which is connected to controller 29.

Furthermore, the housing 3 is provided with a number of injection points 10*a*, 10*b* for the injection of a liquid.

This liquid can for example be synthetic oil or water or otherwise, but the invention is not limited to this as such.

The injection points 10*a*, 10*b* are placed at the location of the compression space 4 and at the location of the aforementioned bearings 8.

Figure 2:
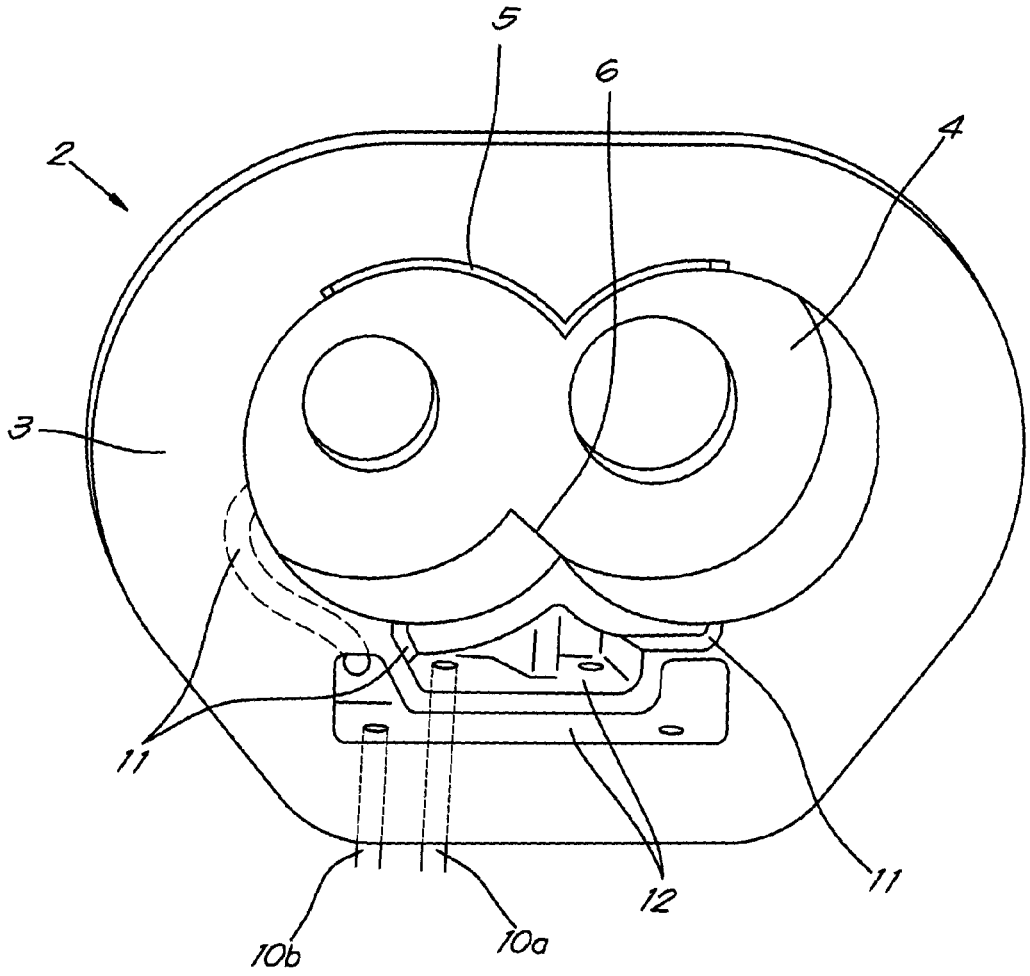
FIG. 2 schematically shows a liquid-injected compressor element according to the invention.

The compressor element 2 is shown in more detail in FIG. 2, with the realisation of the injection points 10*a*, 10*b* thereon.

According to the invention the housing 3 is provided with separated integrated channels 11 that start from the aforementioned injection points 10*a*, 10*b* in the housing 3 and open into the compression space 4 and the aforementioned bearings 8 respectively.

In the example shown in FIG. 1 it is the case that the injection points 10*a*, 10*b* are placed at the location of the aforementioned compression space 4 and at the location of the aforementioned bearings 8 respectively.

However, this is not necessarily the case as due to the provision of the separated integrated channels 11, there is more freedom to place the injection points 10*a*, 10*b* at a different location.

Furthermore, it is possible to provide a separate injection point 10*a*, 10*b* for each channel 11.

However, it is also possible that more than one channel 11 starts from an injection point 10*a*, 10*b*.

As can be seen in FIG. 2, in this case a separate separated integrated channel 11 is provided for each bearing 8.

Moreover, in this case more than one channel 11 is also provided for the compression space 4. In this case there are two channels 11 that run from the injection points 10*a* to the compression space 4.

Additionally one or more cavities 12 can be provided in the housing 3.

In the example shown there are three cavities 12.

One cavity 12 acts as a liquid reservoir for liquid for the compression space 4, the other two cavities 12 act as a liquid reservoir for liquid for the bearings 8.

For the bearings 8 one cavity 12 is provided on the inlet side 5 and one cavity 12 on the outlet side 6.

The cavities 12 ensure a connection between the injection points 10*a*, 10*b* and one or more of the separated integrated channels 11 connected thereto.

It is clear that the injection point 10*a* at the location of the compression space 4 connects to the cavity 12 for liquid for the compression space 4.

The channels 11 that open into the compression space 4 also connect to this cavity 12.

Analogously, the injection points 10*b* at the location of the bearings 8 and the channels 11 that open into the bearings 8 connect to the cavities 12 for liquid for the bearings 8.

It is clear that it is also possible that if the design of the compressor element 2 and the housing 3 so allows, only one injection point 10*b* is provided and one cavity 12 for liquid for the bearings 8. In this case the liquid will be brought to all bearings 8 using the channels 11.

Furthermore, the liquid-injected compressor device 1 comprises a liquid separator 13, whereby the outlet 6 for compressed gas is connected to the inlet 14 of the liquid separator 13.

The liquid separator 13 comprises an outlet 15 for compressed gas, from where the compressed gas can be guided to a consumer network for example, not shown in the drawings.

The liquid separator 13 further comprises an outlet 16 for the separated liquid.

The liquid separator 13 is connected to the aforementioned outlet 16 by means of an injection circuit 17 connected to the compressor element 2.

This injection circuit 17 comprises two separate separated injection pipes 17*a*, 17*b*, which both start from the liquid separator 13.

The injection pipes 17*a*, 17*b* will ensure two separate separated liquid supplies to the compressor element 2.

The injection points 10*a*, 10*b* in the housing 3 ensure the connection of the compressor element 2 to the injection circuit 17.

A first injection pipe 17*a* leads to the aforementioned injection point 10*a* at the location of the compression space 4.

The second injection pipe 17*b* leads to the injection points 10 that are placed at the location of the bearings 8.

As already mentioned above in this case, but not necessarily, there are two injection points 10*b* for the bearings 8, i.e. one for each end of the shaft 9 of the rotor 7.

To this end the second injection pipe 17*b* will be split into two sub-pipes 18*a*, 18*b*, whereby one sub-pipe 18*a*, 18*b* will come out at each end of the shaft 9.

If there is only one injection point 10*b* for the bearings, the channels 11 will take over the function of the sub-pipes 18*a*, 18*b*, or in other words: then these sub-pipes 18*a*, 18*b* are integrated in the housing 3 in the form of two separated integrated channels 11 that run from the injection point 10*b* to the bearings 8.

It is clear that for the aforementioned channels 11, as shown in FIG. 2, it can be said that they form part of the injection circuit 17 and as it were form an extension of the sub-pipes 17*a* and 17*b*. In other words, a part of the injection circuit 17 is integrated in the housing 3.

A cooler 19 is provided in the first injection pipe 17*a*. This cooler 19 can for example, but not necessarily for the invention, be provided with a fan for cooling the liquid that flows through this first injection pipe 17*a*. Of course the invention is not limited as such and another type of cooler 19 can also be used, for example with a cooling liquid such as water or similar.

A controllable valve 20 is also provided, in this case, but not necessarily, a throttle valve.

By means of this throttle valve the quantity of liquid that is injected in the compression space 4 can be adjusted.

A cooler 21 is also provided in the second injection pipe 17*b*, whereby in this case use can be made of a cooling fluid, such as water for example, to cool the liquid or it can be cooled by a fan.

Furthermore, in this case two controllable valves 22 are provided in the second injection pipe 17*b*, one in each sub-pipe 18*a*, 18*b*.

It is also possible that one single controllable valve 22 is provided, for example in the form of a three-way valve at the location of the connecting point P between the two sub-pipes 18*a*, 18*b*.

It is also possible to replace the two valves 22 by one valve 22 that is not a three-way valve, but for example is an ordinary (two-way) control valve, that is provided upstream from the division of the injection pipe 17*b* into the sub-pipes 18*a*, 18*b*.

The operation of the compressor device 1 is very simple and as follows.

During the operation of the compressor device 1 a gas, for example air, will be drawn in via the gas inlet 5 that will be compressed by the action of the rotors 7 and leave the compressor element 2 via the outlet.

As liquid is injected into the compression space 4 during the operation, this compressed air will contain a certain quantity of the liquid.

The compressed air is guided to the liquid separator 13.

There the liquid will be separated and collected underneath in the liquid separator 13.

The compressed air, now free of liquid, will leave the liquid separator 13 via the outlet 15 for compressed gas and can be guided to a compressed gas consumer network, for example, not shown in the drawings.

The separated liquid will be carried back to the compressor element 2 by means of the injection circuit 17.

A proportion of the liquid will be transported to the compression space 4 via the first injection pipe 17*a* and the channels 11 connected thereto, another proportion to the bearings 8 via the second injection pipe 17*b*, the two sub-pipes 18*a*, 18*b* and the channels 11 connected thereto.

Hereby the coolers 19, 21 and the controllable valves 20, 22 will be controlled according to a method that consists of first controlling the mass flow of the liquid supplies, i.e. the controllable valves 20, 22, and then controlling the temperature of the liquid supplies, i.e. the coolers 19, 21.

The aforementioned control is thus a type of master-slave control, whereby the master control, in this case the control of the controllable valves 20, 22, is always done first.

It is important to note here that the coolers 19, 21 and controllable valves 20, 22 are controlled independently of one another, this means that the control of the one cooler 19 is not affected in any way by the control of the other cooler 21 or that the control of the one controllable valve 20 has no effect on the control of the other controllable valves 22.

The control will be such that the properties of the liquid are attuned to the requirements for the compression space 4 and for the bearings 8 respectively.

As mentioned above, by applying both controls a synergistic effect will occur as a result of a functional interaction between the two controls.

Preferably the method consists of controlling the temperature and mass flow of the liquid supplies such that the specific energy requirement of the liquid-injected compressor device 1 is a minimum.

The specific energy requirement (SER) is the ratio of the power (P), e.g., electrical power consumption by the motor 28, of the compressor device 1, which can be determined by the controller 29, to the flow rate (FAD) supplied by the compressor device 1 compared to the standard operating conditions of the compressor element 2. By comparing the SER to the specification of the compressor element 2, the efficiency of the compressor element can be determined.

Although in the examples shown the injection circuit 17 is formed by two separated independent injection pipes 17*a*, 17*b*, it is not excluded that a third independent injection pipe is provided, which leads to the drive of the compressor device 1.

A cooler 19, 21 and a controllable valve 20, 22 can also be incorporated in this third injection pipe.

This third injection pipe will ensure the lubrication and cooling of the drive, whereby this drive can take on the form of a motor with the necessary transmissions and gear wheels.

The control of the cooler 19, 21 and the controllable valve 20, 22 in this third injection pipe can be controlled in the same way as for the other two injection pipes 17*a*, 17*b*, whereby in this case it will be ensured that the quantity and temperature of the injected liquid are optimised for the requirements of the drive.

Although in the example shown the injection circuit 17 comprises two separate separated injection pipes 17*a*, 17*b* both of which start from the liquid separator 13, it is not excluded that only one injection pipe 17*a*, 17*b* starts from the liquid separator 13, whereby this injection pipe 17*a*, 17*b* is split at a location downstream from the liquid separator 13 and upstream from the controllable valve 20. This location can be between the cooler 19 and the controllable valve 20, for example.

An advantage of this is that only one connection between the injection circuit 17 and the liquid separator 13 has to be provided and that the cooler 21 may be omitted.

Figure 3:
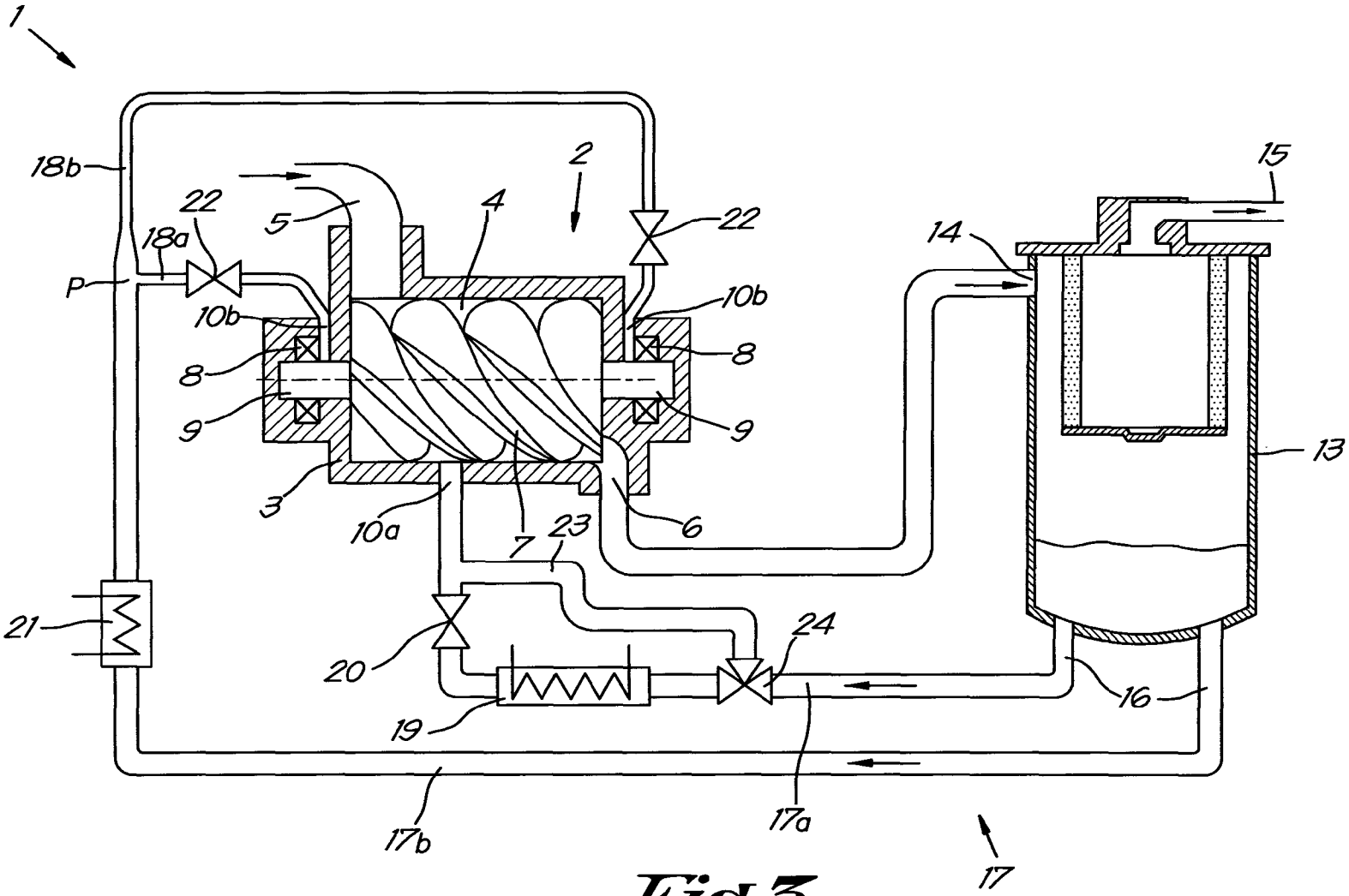
FIGS. 3 to 5 schematically show an alternative embodiment of FIG. 1.

FIG. 3 shows an alternative embodiment of a compressor device 1 according to the invention, which differs from the previous embodiment of FIG. 1 because in this case a bypass pipe 23 is provided across the cooler 19 and the controllable valve 20.

In this case a three-way valve 24 is provided at the tap-off of the bypass pipe 23 upstream from the cooler 19 to control the quantity of liquid that can flow via the bypass pipe 23 and via the cooler 19.

The operation of the compressor device 1 is largely analogous to the operation of the embodiment of FIG. 1.

Only the control of the controllable valve 20 and the cooler 19 for the temperature and the flow rate of the liquid supply to the compression space 4 will be done differently in this embodiment.

When the temperature T at the outlet 6 is still lower than the set value $T_{set}$, the three-way valve 24 will send a proportion of the liquid supply through the bypass pipe 23 instead of through the cooler 19. The liquid that flows through the bypass pipe 23 will not be cooled so that the cooling capacity of the injected liquid in the compression space 4 will decrease.

If necessary, an ever greater proportion of the liquid supply will be sent through the bypass pipe 23 to decrease the cooling capacity and let the temperature T rise above the set value $T_{set}$.

When all the liquid is sent through the bypass pipe 24 and the temperature T is still too low, the quantity of liquid that is injected will be reduced by closing the three-way valve 24 so that less liquid is allowed through.

The quantity of liquid will be decreased until the temperature T is at least equal to the set value $T_{set}$.

Using the cooler 19 and the three-way valve 24 whereby the oil 15 can be sent partly through the bypass pipe 23 and partly through the cooler 19, the cooling capacity can be controlled continuously without the quantity of injected liquid, i.e. the flow rate of the liquid supply, having to be changed for this purpose.

Moreover, only in the last instance is the quantity of injected liquid reduced so that the lubrication and the seal between the rotors 7 and/or the rotors 7 and the housing 3 by the liquid is not reduced.

An analogous control can also be used to ensure that the temperature T at the outlet 6 is not higher than a set value $T_{max}$.

This set value Tmax is limited by an ISO standard and its maximum value is for example equal to the degradation temperature $T_d$ of the liquid. If need be, the set value $T_{max}$ can be a few degrees less than this degradation temperature $T_d$ in order to build in a certain safety, for example 1° C., 5° C. or 10° C., depending on the level of extra safety that is desired or necessary.

If the temperature T at the outlet 6 is higher than the set value $T_{max}$, the three-way valve 24 will increase the flow of the liquid supply that is injected via the bypass pipe 23 into the compression chamber 4 until the temperature T at the outlet 6 falls to the set value $T_{max}$.

If the maximum quantity of liquid is already being injected or if the temperature T at the outlet 6 is still too high when the maximum quantity of liquid is being injected, the three-way valve 24 will send at least a proportion of the liquid supply through the cooler 19.

If this was already the case or if it is insufficient, a larger proportion of the liquid supply will gradually be sent through the cooler 19 until the temperature T falls sufficiently.

When it turns out to be necessary to send the entire liquid supply through the cooler 19 and the cooling capacity is still insufficient to bring the temperature T down to the set value $T_{max}$, then the cooler 19 will switch on, whereby the cooling capacity is increased.

As a result the liquid in the cooler 19 will be cooled more.

The cooling capacity of the cooler 19 is increased until the temperature T at the outlet 6 is, at a maximum, equal to the set value $T_{max}$.

Through a combination of both methods for controlling the temperature, it can be ensured that the temperature T is kept within certain limits in order to increase the lifetime of the liquid and the compressor installation 1.

Moreover, such a method will ensure that the cooler 19 is always switched off first or switched on last when the cooling capacity of the injection circuit 17 has to be decreased or increased respectively, which will provide an energy saving.

Figure 4:
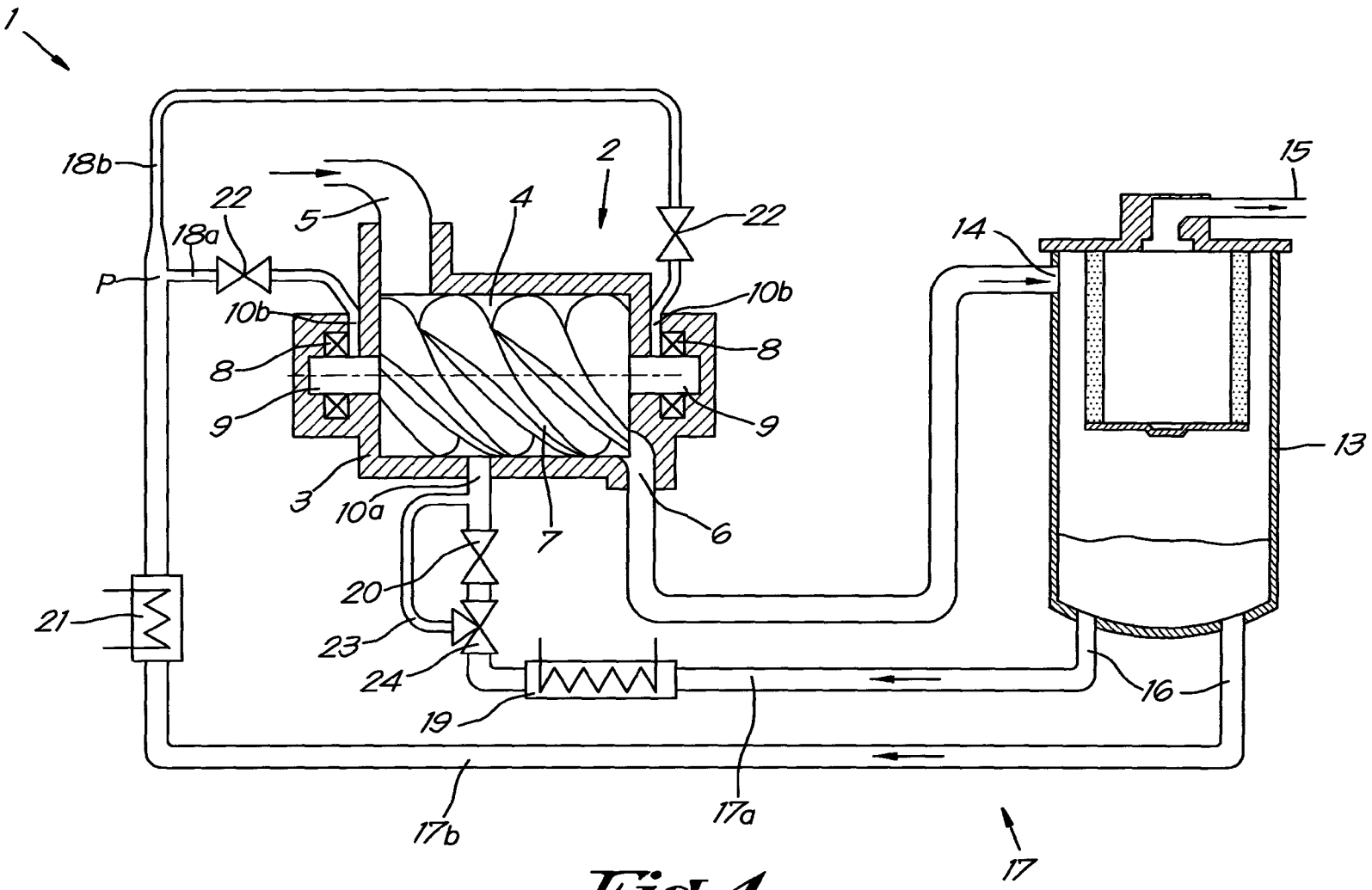

FIG. 4 shows a second alternative embodiment of a compressor device 1 according to the invention.

In this case the aforementioned bypass pipe 23 only extends across the controllable valve 20, which is constructed as a throttle valve for example.

The bypass pipe 23 acts as a safety device if the controllable valve 20 fails so that it can always be ensured that a liquid supply to the compression space 4 is possible.

Figure 5:
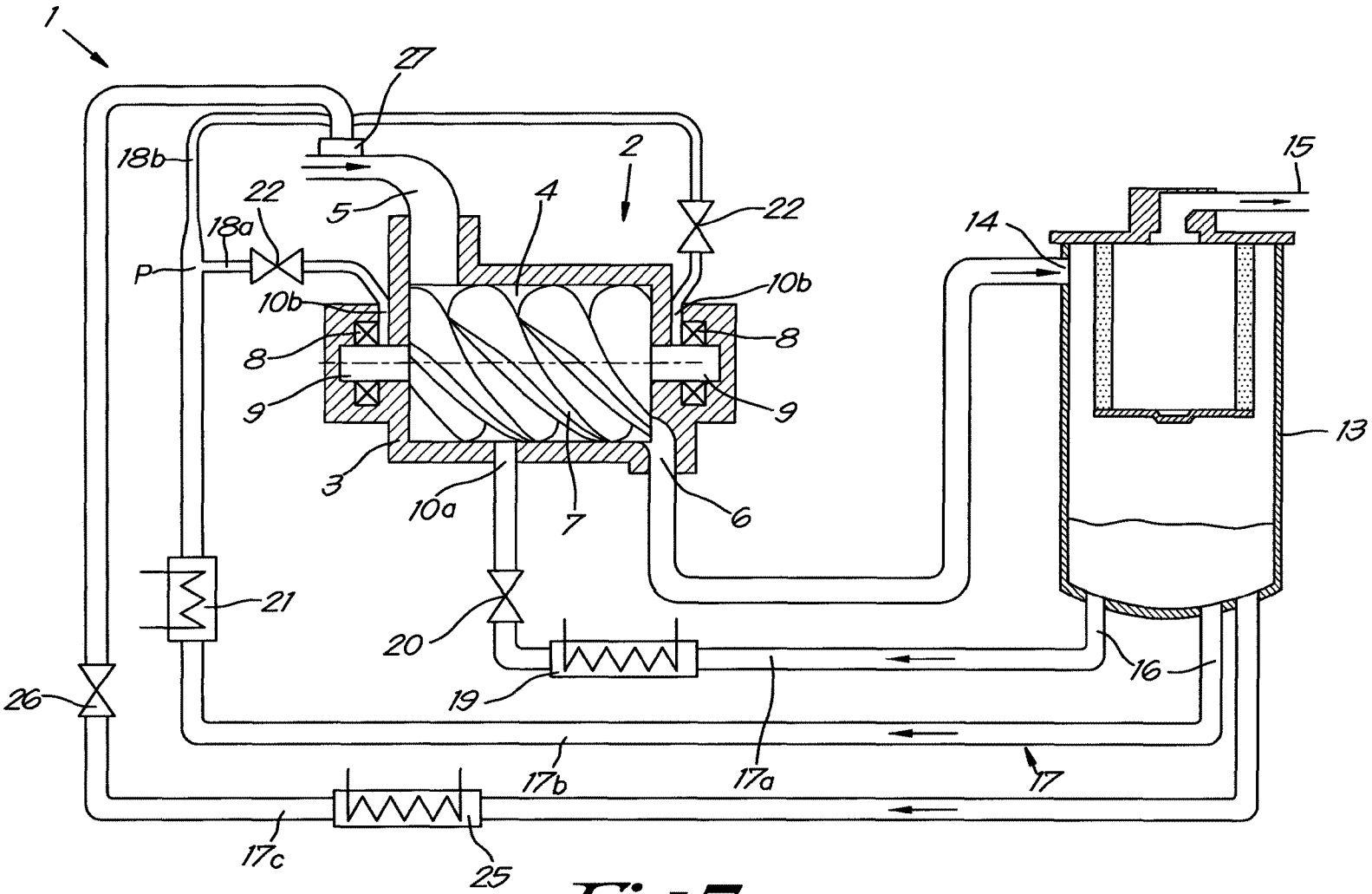

FIG. 5 shows a third alternative embodiment of a compressor device 1 according to the invention.

In this case a third independent injection pipe 17*c* is provided that starts from the liquid separator 13 and leads to the inlet 5.

A cooler 25 is also incorporated in this third injection pipe 17*c*. In this case a controllable valve 26 is also provided to control the liquid flow rate.

Atomisation 27 is also provided in the third injection pipe 17*c* at the location of the inlet 5.

This atomisation 27 will atomise, i.e. spray or nebulise, the liquid supply so that the liquid will go into the inlet 5 as small droplets.

Due to this atomisation the heat transfer between the gas and the liquid will be optimum because a greater contact area between the two is created.

The magnitude of the heat transfer will be determined, among others, by the size of the liquid droplets and their distribution in the gas flow.

The atomisation 27 can comprise a number of high frequency vibrating rods and injection nozzles. An alternative can be an atomisation 27 based on the jet expansion of gas/liquid mixtures.

Preferably the atomisation 27 can be controlled in order to control the size of the droplets and to be able to adapt the distribution of the droplets.

For the third injection pipe 17*c* the temperature of the liquid supply can be controlled by means of the cooler 25, and the flow rate by means of the controllable valve 26, and the spray by means of the atomisation 27.

This will enable the liquid to be injected and atomised in the inlet 5 with an optimum distribution of small liquid droplets and with the desired temperature and flow rate whereby it can respond to the changing (environmental) parameters and requirements regarding lubrication, sealing and cooling.

According to the invention the aforementioned liquid can be oil or water.

The present invention is by no means limited to the embodiments described as an example and shown in the drawings, but such a method for controlling the liquid injection of a compressor device and a liquid-injected compressor device can be realised according to different variants without departing from the scope of the invention.

The invention claimed is:

1. A method for controlling injection of a liquid into a compressor device, said compressor device comprising at least one compressor element, said compressor element comprising a housing that comprises a compression space in which at least one rotor is rotatably situated, the housing further including at least one cavity separated from the compression space that serves as a liquid reservoir for liquid supplied to the compression space, wherein the method comprises the step of:

providing at least two independent separated liquid supplies to the compressor element, wherein at least a first liquid supply is injected into the cavity that serves as a liquid supply for liquid supplied to the compression space and at least a second liquid supply injected into bearings that rotatably support the rotor, wherein the two independent separated liquid supplies are supplied separately and independently from a liquid separator to the at least one cavity and from the liquid separator into the bearings, and controlling both a temperature and a mass flow of the at least first liquid supply using a first cooler and a first controllable valve and a temperature and a mass flow of the at least second liquid supply using a second cooler and at least a second controllable valve.

2. The method according to claim 1, wherein to control the temperature and the mass flow of the liquid supply, the method consists of first controlling the mass flow and then controlling the temperature.

3. The method according to claim 1, wherein the method further comprises steps of:

determining an efficiency of the compressor element by comparing a specific energy requirement of the compressor element to standard operating conditions of the compressor element, and controlling the temperature and the mass flow of the at least two independent separated liquid supplies such that the specific energy requirement is a minimum, whereby the specific energy requirement is the ratio of electrical power of the compressor device to the flow supplied by the compressor device compared to the standard operating conditions of the compressor element.

* * * * *